United States Patent [19]

Linde et al.

[11] Patent Number: 5,036,782

[45] Date of Patent: Aug. 6, 1991

[54] METHOD FOR CONVERTING A SEMI-SUBMERSIBLE VESSEL

[75] Inventors: Lennart Linde, Västra Frölunda; Per-Ake Stalcrona, Gothenburg, both of Sweden

[73] Assignee: Gotaverken Arendal AB, Sweden

[21] Appl. No.: 430,598

[22] Filed: Nov. 1, 1989

[30] Foreign Application Priority Data

Nov. 11, 1988 [SE] Sweden ..... 88040803

[51] Int. Cl.[5] ..... B63B 35/00

[52] U.S. Cl. ..... 114/65 R; 114/265

[58] Field of Search ..... 114/61, 65 R, 71, 264, 114/265, 270; 405/218

[56] References Cited

U.S. PATENT DOCUMENTS

| | | | |
|---|---|---|---|
| 2,921,442 | 1/1960 | Laborde et al. | 114/265 |
| 3,727,414 | 4/1973 | Davies | 114/265 |
| 4,091,760 | 5/1978 | Lloyd | 114/265 |
| 4,487,150 | 12/1984 | Shanks | 114/264 |
| 4,732,103 | 3/1988 | Culbertson | 114/71 |
| 4,763,596 | 8/1988 | Yoshida | 114/265 |

*Primary Examiner*—Sherman Basinger
*Assistant Examiner*—Stephen P. Avila
*Attorney, Agent, or Firm*—Lerner, David, Littenberg, Krumholz & Mentlik

[57] ABSTRACT

A method for converting an existing semi-submersible drilling- or accommodation rig into a floating production plant having apparatus for extracting and processing oil and/or gas, or other heavy and bulky deck load. These vessels comprise at least two submerged pontoon bodies, a work deck raised to a secure level above the surface of water having personnel accommodation areas and upright support columns between the bodies and the work deck. A module is prefabricated which contains the main part of the processing apparatus. The vessel is provided with a steel structure to carry the module near the level of the work deck. Also, the vessel is provided with a displacement increasing device, substantially corresponding to the dead weight of the module and the steel structure. Further, the water line area of the vessel is increased until the necessary deck load capacity and stability is achieved.

6 Claims, 2 Drawing Sheets

METHOD FOR CONVERTING A SEMI-SUBMERSIBLE VESSEL

FIELD OF THE INVENTION

The present invention relates to a method for converting an existing semi-submersible drilling- or accommodation rig which comprises at least two submerged pontoon bodies, a work deck raised to a secure level above the surface of water having personnel accommodation areas and upright support columns between the bodies and the work deck, into a floating production plant having means for extracting and processing oil and/or gas, or other heavy and bulky deck load.

The invention can alternatively be used for conversion of said rigs to floating, so called TSV's (Tender Support Vessels), simply for increasing the load capacity of an existing rig.

STATE OF THE ART

Usually, when converting an old existing drilling platform to a production platform, a large amount of process equipment is added to the work deck, said equipment comprising pumps, separators, electricity generators and equipment for maintenance of the oil well. Usually the increased weight is compensated for by adding sponsons to the submerged pontoon bodies and by adding fenders to the support legs, both measures enhancing the carrying and stabilizing capacity of the rig. Also, the deck box, the bracing and the anchor systems usually will have to be upgraded. All these structural alterations will lead to extensive and expensive welding labor. The integration of the process equipment into the existing deck layout involves time consuming laying of pipes and electric cables. The time schedule for performing the conversion normally means that the existing platform must be taken out of operation for a long time.

In order for a conversion to be cost-effective, one usually starts with a comparatively modern existing platform having a large deck load capacity. Such platforms ar often profitable in their normal role, and they are therefore seldom available for conversion.

OBJECTS OF THE INVENTION

One object of the present invention is to provide a method which can be used for cost-effective conversion of both modern platforms and elder, previously less attractive conversion objects.

SUMMARY OF THE INVENTION

According to the invention, this object is accomplished by prefabricating a module which contains the main part of the process means, providing the vessel with a steel structure to carry the module near the level of the work deck, and providing the vessel with displacement increasing means, substantially corresponding to the dead weight of the module and the steel structure, and increasing the water line area of the vessel until the necessary deck load capacity and stability is achieved.

A preferable embodiment of the invention comprises providing the module with explosion- and fire protecting shielding on that side which faces the accommodation areas.

Preferably the module will be placed at the opposite end of the work deck in relation to the accommodation areas.

According to another preferable variation of the invention, the displacement increasing means comprise extensions of the submerged pontoon bodies, and connection elements between these bodies.

Preferably, the water line area is increased by adding extra support columns.

According to one variation of the invention, the steel structure is prefabricated as an integral unit having extension sections for the submerged pontoon bodies and bracing between said bodies and extra support columns, the integral unit is attached to the existing rig, and the module is lifted up on the integral unit.

Alternatively, the submerged pontoon bodies are extended in sections by means of habitats on the floating existing vessel, support columns are mounted in sections onto the extensions of the submerged pontoon bodies, the work deck is extended out above the support columns, and the module is mounted on the extension of the work deck.

BRIEF DESCRIPTION OF THE DRAWINGS

The invention will now be described in the following, with reference to an embodiment which is shown in the accompanying drawings, in which FIG. 1 in a side view shows a drilling platform which has been converted into a production platform in accordance with the invention.

DESCRIPTION OF A PREFERRED EMBODIMENT

Figure 1:
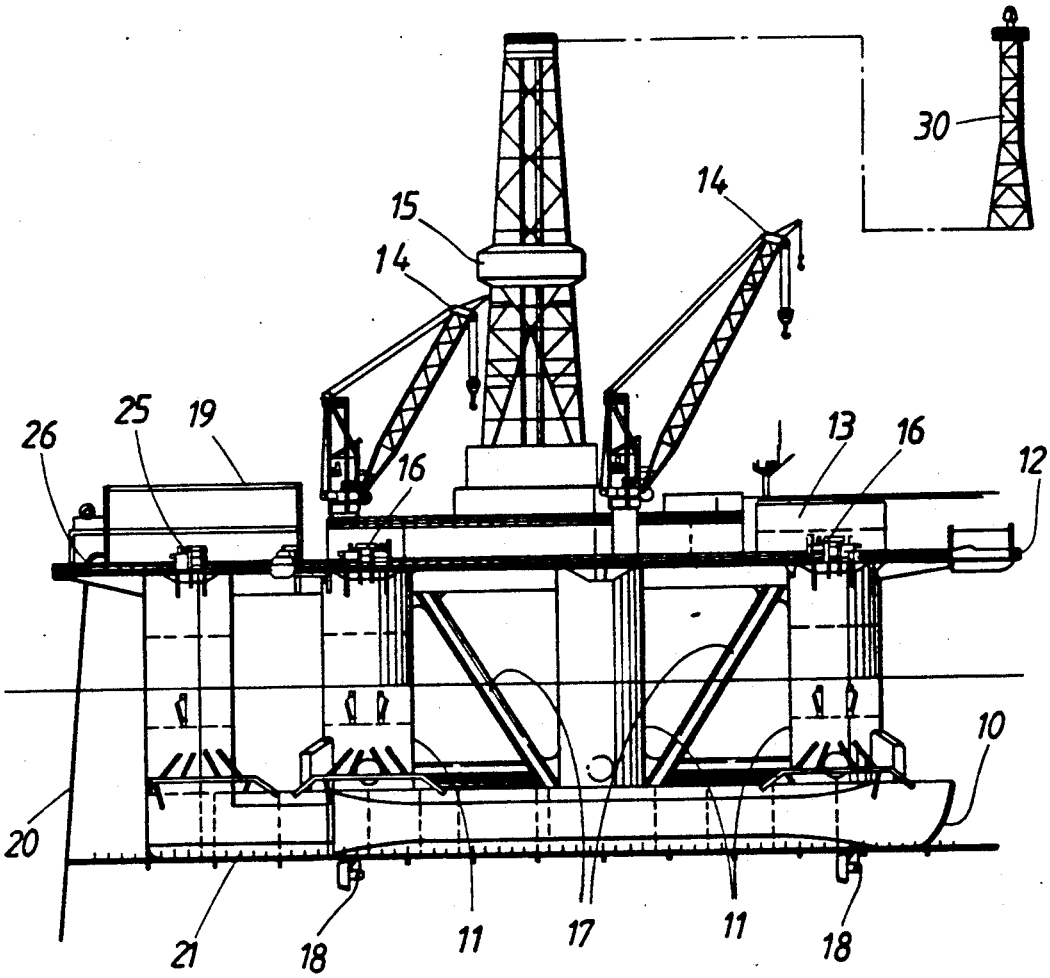
Figure 2:
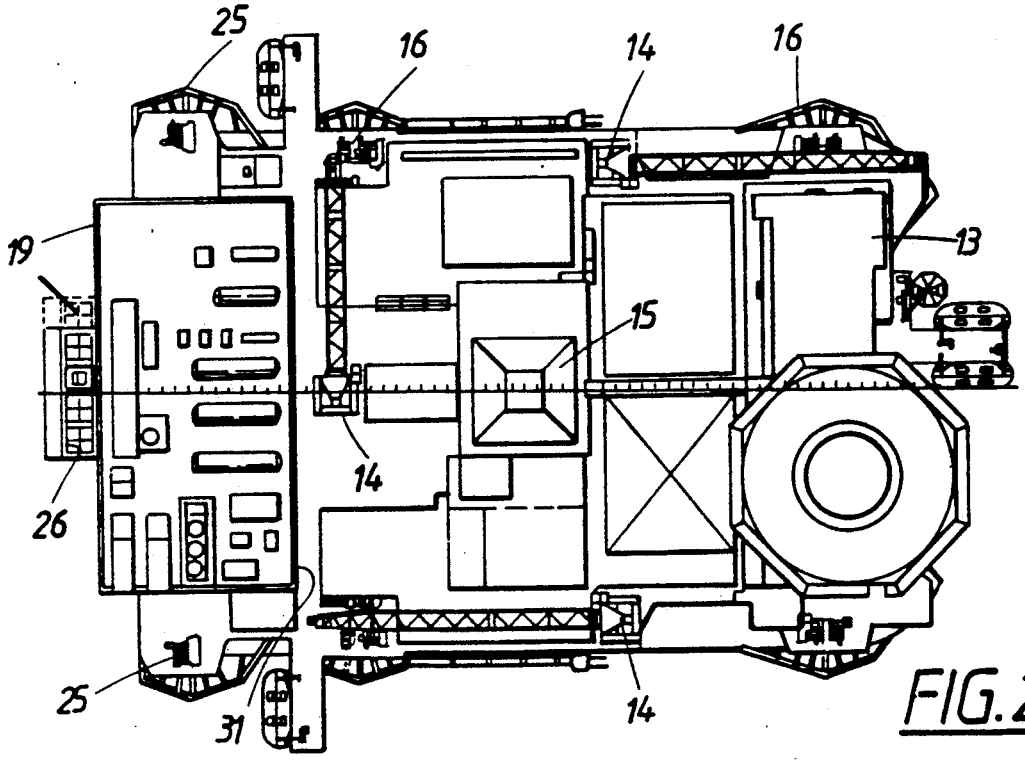
FIG. 2 shows the platform in a view from above.

The off-shore platform shown in FIGS. 1 and 2 comprises in the right part on said figures of old drilling rig of conventional design having two pontoons 10 and six vertical support columns 11 carried by the pontoons. The support columns in their turn carry a work deck 12 having accommodation areas 13, cranes 14, a drilling tower 15 and anchor winches 16. A number of vertical and diagonal braces 17 run between the work deck 12 and the pontoons 10, which are provided with thruster propellers 18. The left part of said figures comprise an additional extension with a process module 19, to which a number of flexible riser lines 20 running down to installations at the sea bottom are connected.

Figure 3:
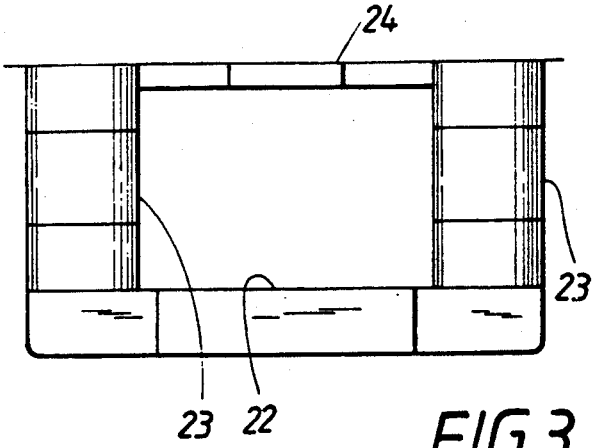
FIG. 3 is an end view diagrammatically showing a prefabricated supplementary platform segment.
Figure 5:
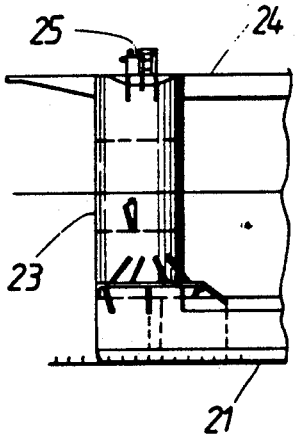
FIG. 5 shows the supplementary platform segment in FIG. 4 in a side view.
Figure 4:
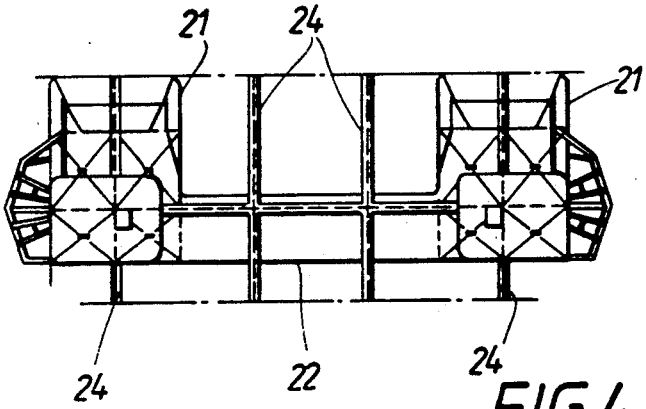
FIG. 4 is a view from above of a supplementary platform segment.

FIGS. 3 to 5 show the steel structure of the additional extension which comprises extensions 21 of the original platform pontoons 10. The extensions 21 are connected via an across element 22, and together they give an increase in displacement mainly corresponding to the dead weight of the module. Each extension 21 is provided with support columns 23 extending up to the level of the work deck and the two support columns together increase the platform water line area and therefore increase the stability of the platform. Beams 24 are mounted in the manner of a frame upon the support columns 23, said beams connecting the upper ends of the support columns to the work deck 12 of the original platform forming a base for the module 19. The additional extension is provided with room for an increased anchor system 25.

The above described additional extension can be made in such a way that it increases the structural life of the original platform. This strengthening can also be made substantially without time consuming alterations in the original existing construction. As the additional extension does not have to involve any structural or hydrostatic load upon the original platform design, but instead may strengthen it, a large number of previously not conceivable, relatively out of date platforms may now be interesting as objects for conversion.

The cost of converting a platform can be kept low because the additional extension can be prefabricated and then attached to the existing platform, e.g. inside a dock, so that the existing platform does not have to be taken out of operation for more than perhaps three months. This should be compared with a conventional conversion wherein the platform has to be taken out of service for about 12 months.

Figure 6:
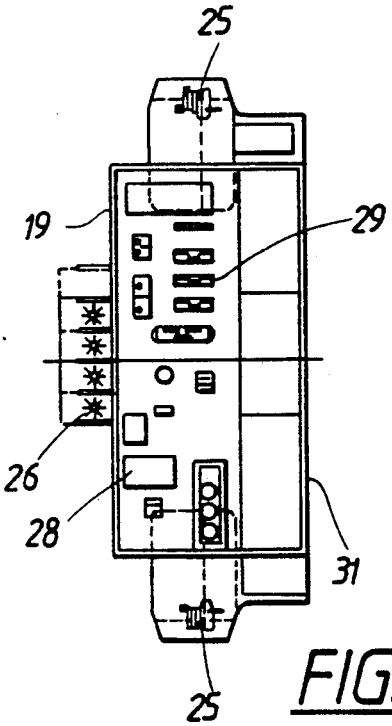
FIG. 6 shows the main deck in a supplementary module for production equipment.
Figure 7:
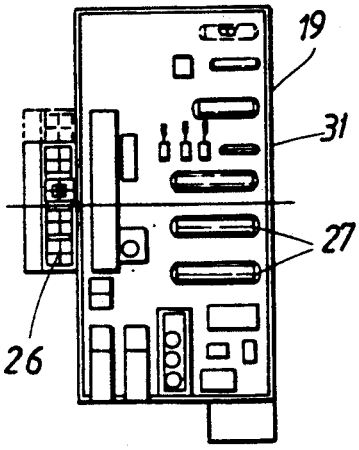
FIG. 7 shows the mezzanine deck in the same module.

The module 19 is shown in more detail in FIGS. 6 and 7 and it is preferably prefabricated in such a way that it contains all fire hazardous production systems, control systems for the process and for the sea bottom installations, and as much of the utility systems as is practical. Thus, the riser termination 26, the separators 27 for oil, gas, water and sludge, means 28 for stabilization of crude oil and natural gas together with pumps 29 for export of oil and/or gas and means for controlling the pressure in the oil well by means of injection of water and gas etc. are well separated from the drilling tower 15, from the work shops and from the accommodation areas 13. Flaring can be done via an addition 30 to the drilling tower 15.

That side of the module which faces the original platform has been provided with a double wall 31 which is constructed to withstand fire and explosion blasts.

By the above described configuration of the production platform, the risks of serious damage during an accident will be substantially reduced.

The invention is not limited to the above described embodiment, but several variations are possible within the scope of the accompanying claims. For example, the additional extension does not have to be prefabricated as a complete unit, but can instead be built in sections on the original platform, which does not have to be dry docked if habitats are used for assembling the sections. The additional extension can be equipped with its own system for handling ballast water or, alternatively, a system which is integrated with the original platform. The same is applicable for electrical systems and fire extinguishing systems.

What we claim:

1. A method for converting a semi-submersible drilling or accommodation rig into a floating production plant vessel, said semi-submersible drilling or accommodation rig having at least two pontoon bodies submerged below the surface of a body of water to produce a rig water displacement, a plurality of support columns extending upright from said at least two pontoon bodies and intersection the surface of said body of water to define a water line area for said rig, and a work deck including an accommodation area arranged on said plurality of support columns and disposed at a level above the surface of said body of water, said floating production plant vessel including said at least two pontoon bodies, said plurality of support columns, and said work deck and further including processing apparatus, said method comprising the steps of:

prefabricating a module including said processing apparatus, providing a side of said module facing said accommodation area with explosion and fire protection shielding, connecting said module to said semi-submersible drilling or accommodation rig proximate to said level of said work deck by means of a support structure, said module and said support structure having a predetermined combined weight, increasing said rig water displacement by an amount substantially corresponding to said predetermined combined weight to produce a vessel water displacement greater than said rig water displacement, and providing said vessel with a water line area greater than said water line area of said rig, whereby said greater water line area increases the deck load capacity and stability of said vessel.

2. A method as claimed in claim 1 wherein said accommodation area is located at one end of said work deck and said step of connecting said module near said level of said work deck comprises connecting said module to an end of said work deck opposite said accommodation area.

3. A method as claimed in claim 2 wherein said step of increasing said rig water displacement comprises connecting an extension to each of said at least two pontoon bodies and providing connecting elements between said extensions.

4. A method as claimed in claim 3 wherein said step of providing said vessel with a water line are greater than said water line area of said rig comprises assembling additional support columns to said vessel.

5. A method as claimed in claim 4 wherein said support structure is prefabricated as an integral unit including said extensions for said at least two pontoon bodies, said connecting elements provided between said extensions and said additional support columns, and wherein said integral unit is connected to said rig and said module is assembled on said integral unit.

6. A method as claimed in claim 4 wherein one of said extensions is connected to each of said at least two pontoon bodies, said additional support columns are assembled onto said extensions, said work deck is extended above said additional support columns, and said module is mounted on said work deck extension.

* * * * *

UNITED STATES PATENT AND TRADEMARK OFFICE

CERTIFICATE OF CORRECTION

PATENT NO. : 5,036,782

DATED : August 6, 1991

INVENTOR(S) : Linde et al.

It is certified that error appears in the above-identified patent and that said Letters Patent is hereby corrected as shown below:

Column 1, line 44, delete "ar" and insert therefor --are--.

Column 4, line 3, "intersection" should read --intersecting--.

Signed and Sealed this

Ninth Day of February, 1993

*Attest:*

STEPHEN G. KUNIN

*Attesting Officer*

*Acting Commissioner of Patents and Trademarks*